US008695972B2

(12) United States Patent
Choi et al.

(10) Patent No.: US 8,695,972 B2
(45) Date of Patent: Apr. 15, 2014

(54) INVERTER WITH ADJUSTABLE REVERSING ROLL POSITION

(75) Inventors: Injae Choi, Webster, NY (US); Joannes N. deJong, Hopewell Junction, NY (US); Steven R. Moore, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/365,674

(22) Filed: Feb. 3, 2012

(65) Prior Publication Data

US 2013/0200564 A1 Aug. 8, 2013

(51) Int. Cl.
*B65H 5/00* (2006.01)
*B65H 29/00* (2006.01)
*B65H 39/10* (2006.01)

(52) U.S. Cl.
USPC ..... 271/225; 271/184; 271/185; 271/186; 271/902; 271/291

(58) Field of Classification Search
USPC ..... 271/184–186, 225, 902, 291
See application file for complete search history.

(56) References Cited

U.S. PATENT DOCUMENTS 4,580,774 A * 4/1986 Yamaguchi et al. ..... 271/176
4,692,020 A 9/1987 Tsujihara
5,110,104 A * 5/1992 Wakao et al. ..... 271/3.03
5,166,738 A * 11/1992 Tani ..... 399/402
5,449,164 A 9/1995 Quesnel et al.
5,465,955 A * 11/1995 Krupica et al. ..... 271/265.02
5,473,419 A * 12/1995 Russel et al. ..... 399/130
5,629,762 A 5/1997 Mahoney et al.
5,720,478 A 2/1998 Carter et al.
6,032,004 A 2/2000 Mirabella, Jr. et al.
6,206,817 B1 3/2001 Sette et al.
6,341,777 B1 * 1/2002 Carter ..... 271/291
6,450,711 B1 9/2002 Conrow
6,460,847 B1 * 10/2002 Boss ..... 271/225
6,626,103 B2 9/2003 Neumann
6,782,236 B2 * 8/2004 Sasaki et al. ..... 399/401
7,766,327 B2 * 8/2010 DeGruchy ..... 271/272
7,992,854 B2 * 8/2011 Mandel et al. ..... 270/58.01
8,322,720 B2 * 12/2012 DeGruchy ..... 271/273
2005/0139094 A1 6/2005 Kyytsonen

FOREIGN PATENT DOCUMENTS

JP 63139827 * 6/1988 ..... B65H 1/30

* cited by examiner

*Primary Examiner* — Patrick Cicchino
(74) *Attorney, Agent, or Firm* — Gibb & Riley, LLC

(57) ABSTRACT

A reversing apparatus within a media path comprises an input nip moving sheets of media in a first direction, and a reversing nip positioned to receive the sheets of media from the input nip. The reversing nip stops the sheets and moves the sheets in a second direction opposite the first direction. Also included is an output nip positioned to receive the sheets of media from the reversing nip, and an actuator connected to the reversing nip. The actuator moves the reversing nip relative to a position of the input nip and the output nip, based on a characteristic of the sheets of media.

5 Claims, 5 Drawing Sheets

INVERTER WITH ADJUSTABLE REVERSING ROLL POSITION

BACKGROUND

Embodiments herein generally relate to printing devices and more particularly printing devices that include a reversing roll.

Some printing devices have the ability to print on both sides of sheets of media (paper, transparencies, card stock, etc.) and this process is generally referred to as duplexing or duplex printing. To perform duplex printing, generally marks are printed by some form of printing engine (electrostatic, ink jet, solid ink, etc.) on one side of a sheet, the sheet is turned over and returned to the printing engine using a reversing nip and a duplex loop, and then marks are printed on the other side of the sheet. The sheet is then output with markings printed on both sides.

In reversing roll inverter technology for sheet inversion, generally a pair of reversing rolls captures the lead edge of the sheet to be inverted and then the reversing rolls reverse the movement of the sheet to drive the sheets into another media path (the duplex loop) back toward the printing engine. However, the inversion speed of such reversing roll inverters is limited. Other arrangements flip the sheet by rotating along the sheet moving direction while the sheet is in the duplex loop, but such arrangements may require a long duplex loop.

SUMMARY

An exemplary printing apparatus herein includes a printing engine and a media path moving sheets of media toward and away from the printing engine. Further, there is a reversing apparatus within the media path. The reversing apparatus includes a tri-roll structure that comprises a top or "first' roller, a bottom or "second" roller, and a middle or "third" roller positioned between and contacting the first roller and the second roller. One or more of the rollers are driven (such as the middle roller). Nips are formed at points where opposing rollers contact each other. Thus, the tri-roll structure provides an input nip between the middle roller and the bottom roller, and provides an output nip between the middle roller and the top roller.

The input nip moves sheets of media in a first direction (e.g., sometimes referred to as a processing direction). A reversing nip that is physically separate from the tri-roll structure is positioned relative to the tri-roll structure to receive the sheets of media from the input nip that are moving in the first direction. The reversing nip selectively stops some of the sheets (e.g., the sheets that are to be inverted, inverted sheets may be sent to a duplex loop, a finisher, etc.) and moves such sheets in a second direction opposite the first direction (reverses the sheets) to perform operations, such as duplex printing. Thus, the second direction can move the sheets of media back toward, for example, the printing engine for additional printing. The output nip is positioned relative to the reversing nip to receive the sheets of media from the reversing nip that are moving in the second direction.

Further, an actuator can be connected to the reversing nip, or multiple reversing nips could be utilized. The actuator can comprise, for example, an electric motor, a piston, and/or a driven screw adjuster, etc. The actuator dynamically moves the reversing nip in the first direction and the second direction relative to the fixed position of the tri-roll structure based on one or more characteristics of the sheets of media, such as the weight or length of the sheets of media. The reversing nip is therefore dynamically positioned by the actuator to have the sheets of media always be within at least one nip (the input nip, the reversing nip, and/or the output nip). In alternative embodiments, rather than a single reversing nip moved by an actuator, one of multiple reversing nips can be selectively engaged to provide different reversing nip positions with reference to the input and output nips.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

As mentioned above, the inversion speed of reversing roll inverters is limited and other arrangements may require a long duplex loop. In view of this, the structures disclosed herein extend the capability of reversing roll inverter technology by providing a pair of reversing rolls that move to adjust the distance from the input/output nip, depending upon sheet length to be inverted. That is, for a longer sheet, the distance from the input/output nip to the reversing roll nip increases. The increase of this distance enables the earlier departure of sheet from the reversing roll nip when compared to a fixed position nip, which improves the inverter productivity and speed.

Figure 8:
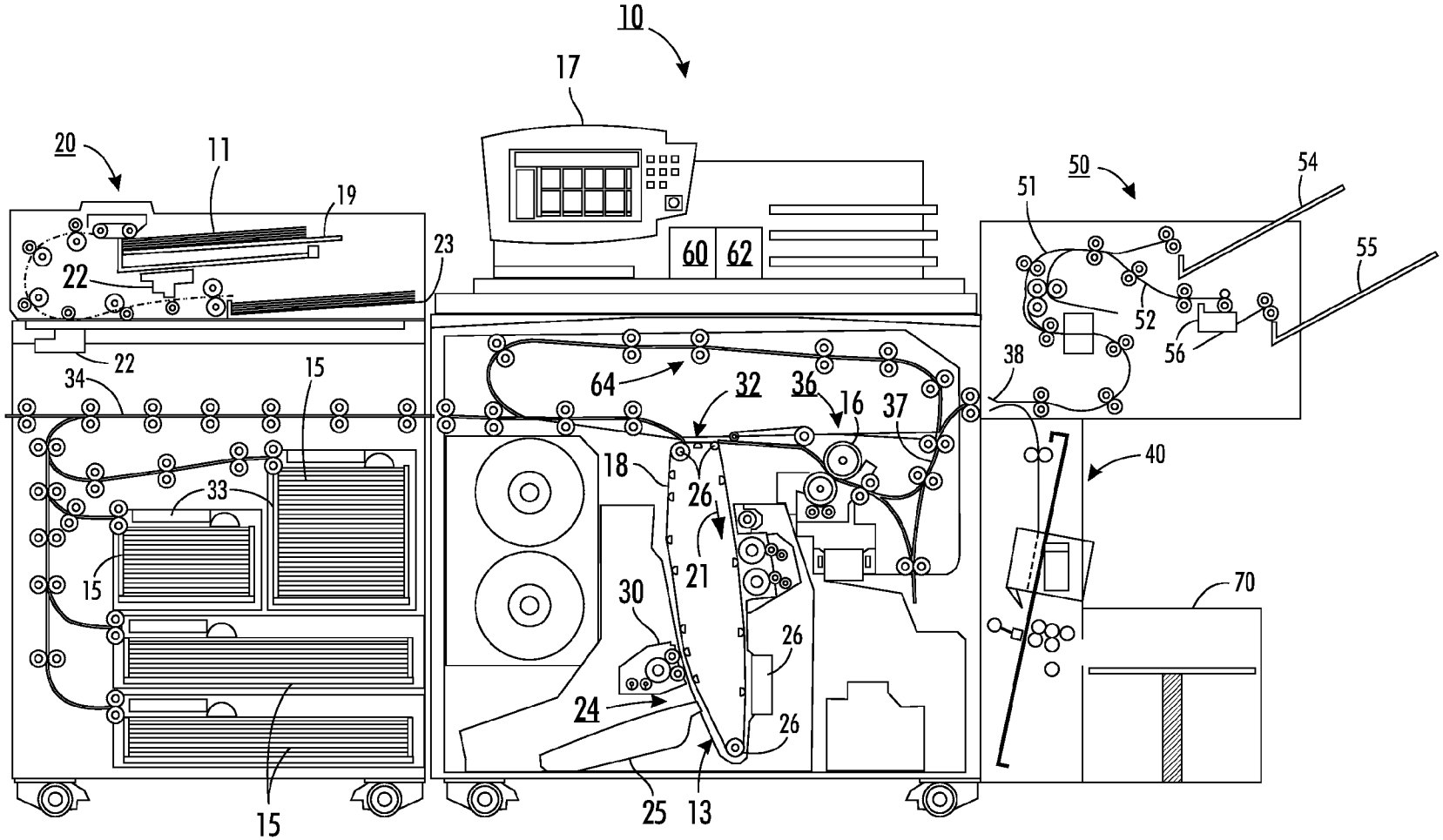
FIG. 8 is a diagram of a printing system containing a device according to embodiments herein.

As shown in the drawings, an exemplary printing apparatus herein includes a printing engine and various media paths moving sheets of media toward and away from the printing engine (FIG. 8, discussed in detail below). As shown, there can be a reversing apparatus within the media path.

Figure 1:
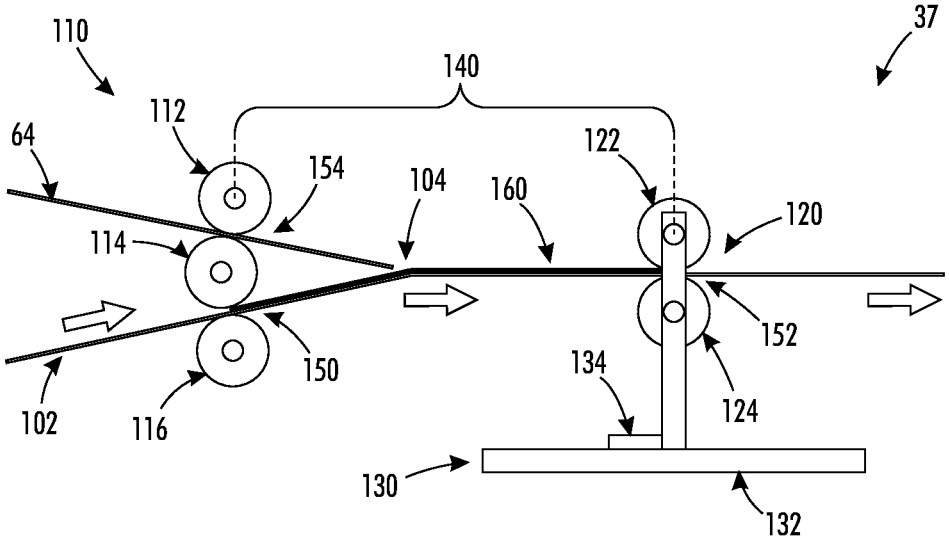
FIG. 1 is a side-view schematic diagram of a device according to embodiments herein.

As shown in FIG. 1, the reversing apparatus includes a tri-roll structure 110 that comprises a top or "first' roller 112, a bottom or "second" roller 116, and a middle or "third" roller 114 positioned between and contacting the first roller 112 and the second roller 116. One or more of the rollers are driven (such as the middle roller 114). Nips are formed at points where opposing rollers contact each other. Thus, the tri-roll structure 110 provides an input nip 150 between the middle roller 114 and the bottom roller 116, and provides an output nip 154 between the middle roller 114 and the top roller 112.

Figure 2:
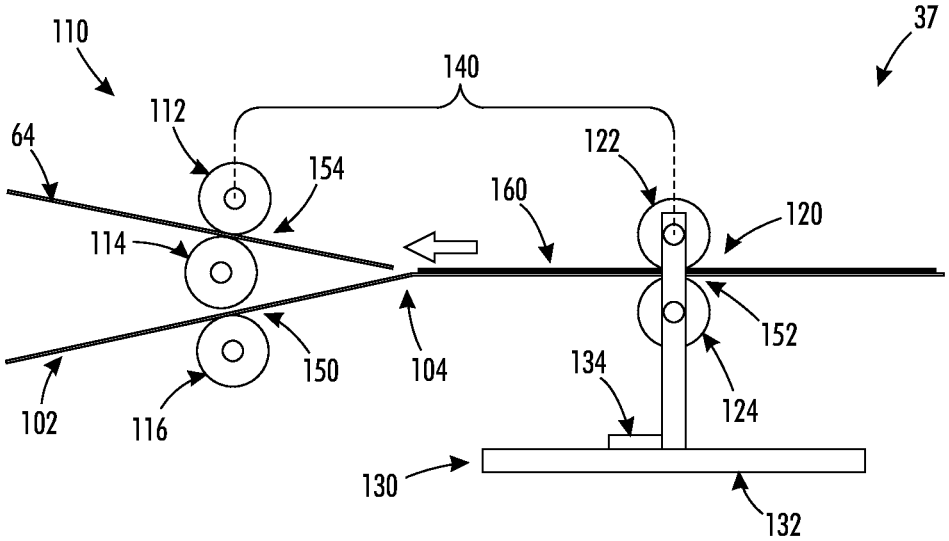
FIG. 2 is a side-view schematic diagram of a device according to embodiments herein.

The input nip 150 moves sheets of media in an arbitrarily named "first" or processing direction as indicated by the arrows in FIG. 1. A reversing nip 152 formed between upper and lower rollers 122/124 that is physically separate from the tri-roll structure 110 is positioned relative to the tri-roll structure 110 to receive the sheets of media from the input nip 150 that are moving in the first direction. The reversing nip 152 can let sheets continue in the first direction (as shown in FIG. 1) or the reversing nip 152 can selectively stop some of the sheets and move such sheets in an arbitrarily named "second" direction opposite the first direction (reverse the sheets) as indicated by the arrow in FIG. 2 to perform operations such as duplex printing. Thus, the second direction can move the sheets of media back toward, for example, the printing engine for additional printing.

Figure 3:
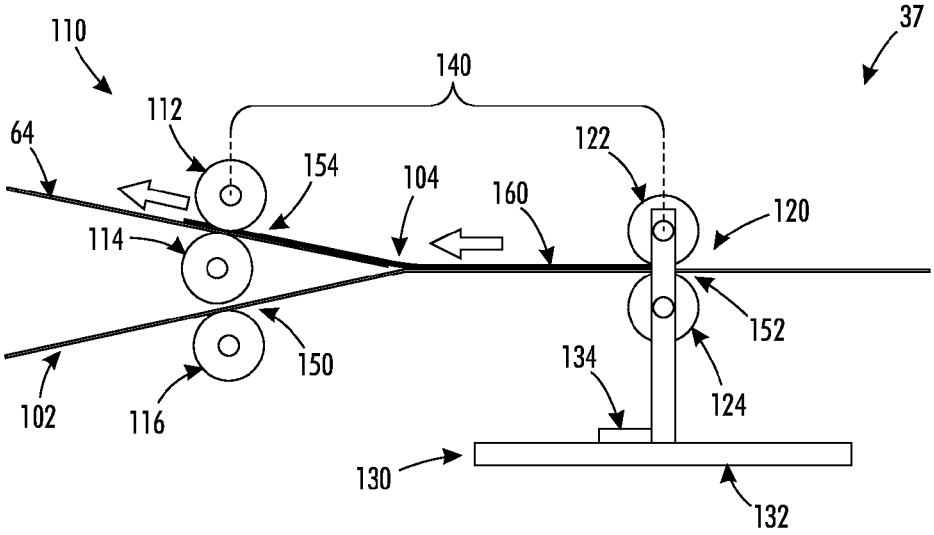
FIG. 3 is a side-view schematic diagram of a device according to embodiments herein.
Figure 4:
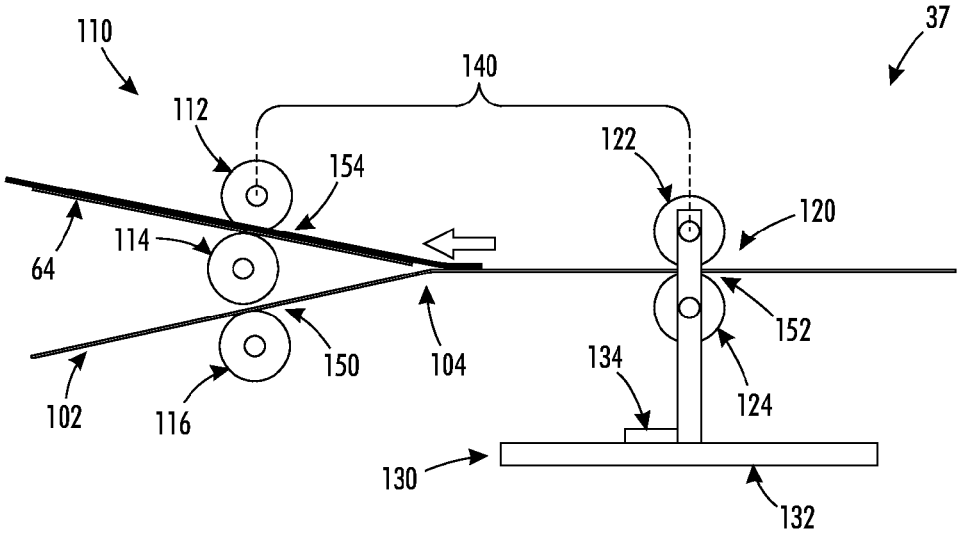
FIG. 4 is a side-view schematic diagram of a device according to embodiments herein

As shown in FIGS. 3 and 4, the output nip 154 is positioned relative to the reversing nip 152 to receive the sheets of media from the reversing nip 152 that are moving in the second direction. As would be understood by those ordinarily skilled in the art, many different types of gating devices 104 (not illustrated in detail) could be used to prevent sheets from traveling the wrong direction back down the input media path 102 instead of the output media path 64 when the sheets are reversed by the reversing nip 152.

Figure 5:
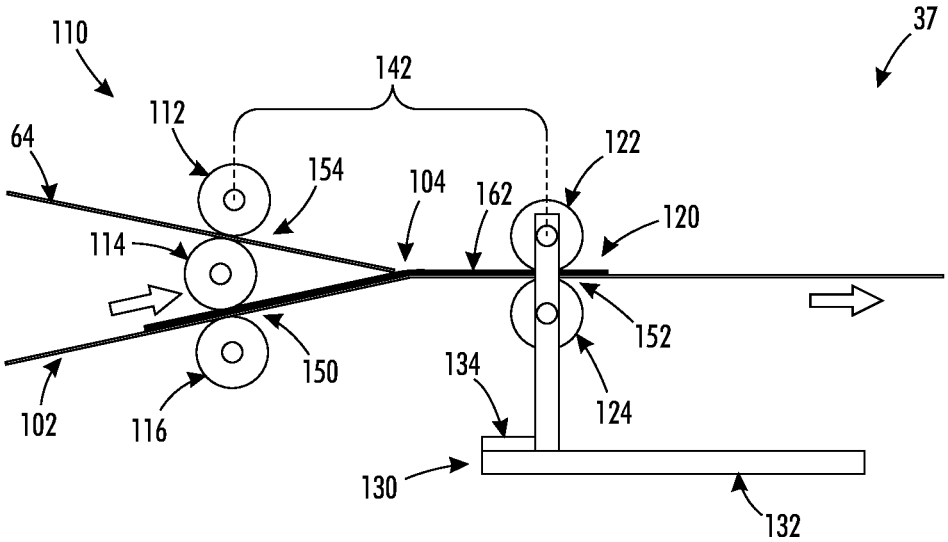
FIG. 5 is a side-view schematic diagram of a device according to embodiments herein.
Figure 6:
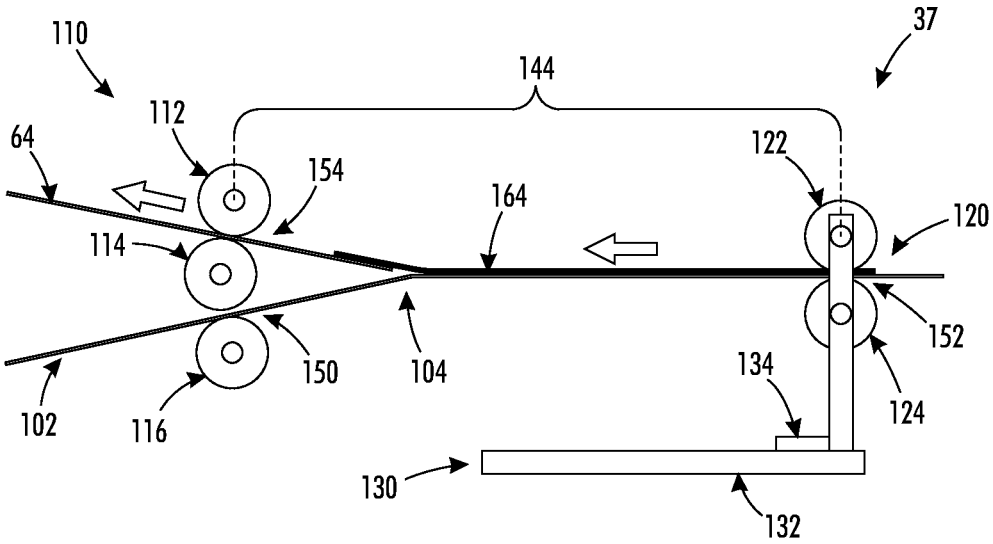
FIG. 6 is a side-view schematic diagram of a device according to embodiments herein.

As also illustrated in FIGS. 1-6, an actuator 134 is connected to the reversing nip 152, for example, by way of a frame 132 of an adjustment device 130. The actuator 134 can comprise, for example, an electric motor, a piston, and/or a driven screw adjuster, etc., and can be controlled by a controller/processor, such as the processor 60 discussed with respect to FIG. 8, below. The actuator 134 as controlled by the controller 60 dynamically moves the reversing nip 152 in the first direction (as shown in FIG. 6) and the second direction (as shown in FIG. 5) relative to the fixed position of the tri-roll structure 110 based on one or more characteristics of the sheets of media, such as the weight or length of the sheets of media.

Thus, as shown in FIGS. 1-4, the distance between the input nip 150 and the output nip 154 (which are in a fixed position) and the movable reversing nip 152 is shown as distance 140. For a relatively short sheet 162, the actuator 134 moves the reversing nip 152 closer to the tri-roll structure 110 (in the second direction) to a distance 142, as shown in FIG. 5. To the contrary, for a relatively long sheet 164, the actuator 134 moves the reversing nip 152 further away from the tri-roll structure 110 (in the first direction) to a distance 144, as shown in FIG. 6. The reversing nip 152 is therefore dynamically positioned by the actuator 134 to have the sheets of media 160-164 be continuously within at least one nip. Thus, the sheets could be in one nip or two nips (one or two of the input nip 150, the reversing nip 152, and/or the output nip 154).

However, the distance between the reversing nip 152 and the input nip 150 is controlled by the controller 60 to cause the least length of the sheet to travel into the reversing nip 152, so as to reduce the amount of time the sheet moves in the reversing nip 152. In other words, the reversing nip 152 is positioned just far enough from the input nip 150 to allow the sheet to be simultaneously held by both the input nip 150 and the reversing nip 152 (as shown, for example, in FIG. 1). Therefore, at the extreme, the distance between the input nip 150 and the reversing nip 152 is dynamically controlled to be approximately equal to, or just slightly less than the length of the sheet, if and when the sheet length changes (e.g., input nip to reverse nip spacing set to 90%, 95%, 99%, etc., of sheet length). In additional embodiments, this distance can be altered depending upon the weight of the sheets of media, to consider buckling, folding, jamming, etc. This allows the reversing nip 152 to be as far from the gate 104 as it is operationally possible when the trailing edge of the sheet is located at the gate 104, causing the minimum length of sheet to enter the reversing nip 152 (reducing the amount of time the sheet is present in the reversing nip 152 and allowing more time for nip 152 to reverse its direction prior to arrival of the next sheet).

Thus, the position of the reversing nip 152 is controlled to be as far as possible from the input nip 150. Since the sheet should be engaged in at least one nip, the distance from the tri-roll nips 150, 154 to the reversing roll nip 152 should be just shorter than the sheet length (e.g., 90%, 95%, 99%, etc., of sheet length). In addition, a long lightweight paper may have difficulty being driven to the next nip (due to increased risk of buckling) and thus the structures herein can also compensate for this by decreasing the distance between the reversing nip 152 and the tri-roll structure 110 to an amount that compensates for the buckling. Further, some buckling may be allowable by using baffles.

While a tri-roll structure 110 is shown in the previous examples, those ordinarily skilled in the art would understand that the movable reversing nip 152 could be similarly used with other structures, such as two sets of rolls forming independent input and output nips.

As soon as the inverted sheet's lead edge enters the output nip 154 and its trail edge leaves the reversing roll nip 152, the reversing rolls 120 change direction so that the reversing rolls 120 surface speed matches the next incoming sheet. Further, because of the position of the movable reversing nip 152, the lead edge of next sheet arrives at the reversing nip 152 as late as possible, allowing the sheet to spend the least amount of time in the reversing nip 152. This time advantage becomes useful for inverting sheets as the productivity of the copier/printer increases.

Figure 7:
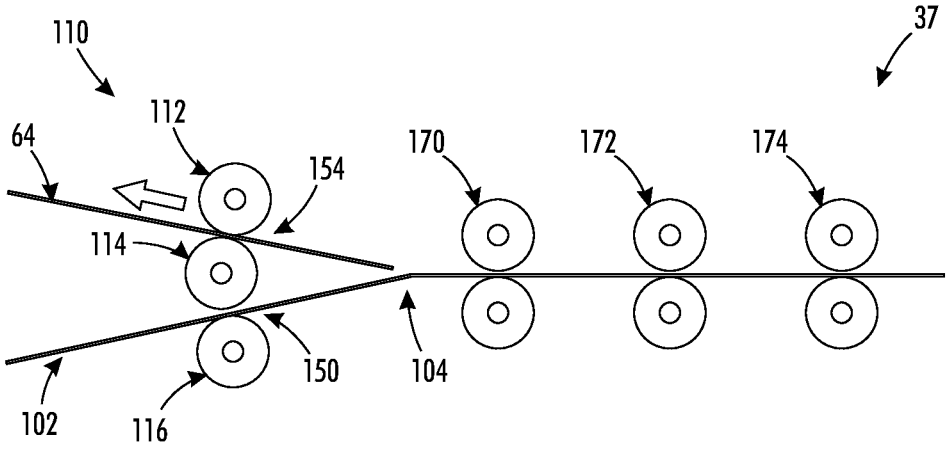
FIG. 7 is a side-view schematic diagram of a device according to embodiments herein.

It may also be noted that, as shown in FIG. 7, multiple sets of reversing rolls 170, 172, 174 may replace the moving reversing rolls 120. Only one of the multiple sets of reversing rolls 170, 172, 174 is engaged at a time, depending upon the sheet length, to similarly increase the distance from the input/output nip 110 to the reversing rolls in discrete steps, which again reduces the amount of time a sheet is present in the reversing roll. More specifically, the controller/processor 60 is operatively connected to the reversing nips and the controller dynamically engages only one of the reversing nips 170 172, 174 at a time based on the length and weight characteristics of the sheets of media. For example, the controller 60 can selectively open the gaps between the non-used rollers to cause only one of the reversing nips to engage a given sheet.

Referring to the FIG. 8, a printing machine 10 is shown that includes an automatic document feeder 20 (ADF) that can be used to scan (at a scanning station 22) original documents 11 fed from a tray 19 to a tray 23. The user may enter the desired printing and finishing instructions through the graphic user interface (GUI) or control panel 17, or use a job ticket, an electronic print job description from a remote source, etc. The control panel 17 can include one or more processors 60, power supplies, as well as storage devices 62 storing programs of instructions that are readable by the processors 60 for performing the various functions described herein. The storage devices 62 can comprise, for example, non-volatile storage mediums including magnetic devices, optical devices, capacitor-based devices, etc.

An electronic or optical image or an image of an original document or set of documents to be reproduced may be projected or scanned onto a charged surface 13 or a photoreceptor belt 18 to form an electrostatic latent image. The belt photoreceptor 18 here is mounted on a set of rollers 26. At least one of the rollers is driven to move the photoreceptor in the direction indicated by arrow 21 past the various other known electrostatic processing stations including a charging station 28, imaging station 24 (for a raster scan laser system 25), developing station 30, and transfer station 32.

Thus, the latent image is developed with developing material to form a toner image corresponding to the latent image. More specifically, a sheet 15 is fed from a selected paper tray supply 33 to a sheet transport 34 for travel to the transfer station 32. There, the toned image is electrostatically transferred to a final print media material 15, to which it may be permanently fixed by a fusing device 16. The sheet is stripped from the photoreceptor 18 and conveyed to a fusing station 36 having fusing device 16 where the toner image is fused to the sheet. A guide can be applied to the substrate 15 to lead it away from the fuser roll. After separating from the fuser roll, the substrate 15 is then transported by a reversing apparatus 37 to either a duplex loop 64 or to output trays and a multi-function finishing station 50.

Printed sheets 15 from the printer 10 can be accepted at an entry port 38 and directed to multiple paths and output trays 54, 55 for printed sheets, corresponding to different desired actions, such as stapling, hole-punching and C or Z-folding. The finisher 50 can also optionally include, for example, a modular booklet maker 40 although those ordinarily skilled in the art would understand that the finisher 50 could comprise any functional unit, and that the modular booklet maker 40 is merely shown as one example. The finished booklets are collected in a stacker 70. It is to be understood that various rollers and other devices, which contact and handle sheets within finisher module 50 are driven by various motors, solenoids and other electromechanical devices (not shown), under a control system, such as including the microprocessor 60 of the control panel 17 or elsewhere, in a manner generally familiar in the art.

Thus, the multi-functional finisher 50 has a top tray 54 and a main tray 55 and a folding and booklet making section 40 that adds stapled and unstapled booklet making, and single sheet C-fold and Z-fold capabilities. The top tray 54 is used as a purge destination, as well as, a destination for the simplest of jobs that require no finishing and no collated stacking. The main tray 55 can have, for example, a pair of pass-through sheet upside down staplers 56 and is used for most jobs that require stacking or stapling As would be understood by those ordinarily skilled in the art, the printing device 10 shown in FIG. 8 is only one example and the embodiments herein are equally applicable to other types of printing devices that may include fewer components or more components. For example, while a limited number of printing engines and media paths are illustrated in FIG. 8, those ordinarily skilled in the art would understand that many more media paths and additional printing engines could be included within any printing device used with embodiments herein.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein cannot be implied or imported from any above example as limitations to any particular order, number, position, size, shape, angle, color, or material.

What is claimed is:

1. A reversing apparatus within a media path, said reversing apparatus comprising:

an input nip moving sheets of media in a first direction;

a plurality of reversing nips positioned to receive said sheets of media from said input nip, said reversing nips stopping said sheets and moving said sheets in a second direction opposite said first direction;

an output nip positioned to receive said sheets of media from said reversing nips; and a controller operatively connected to said reversing nips, said controller engaging only one of said reversing nips based on a characteristic of said sheets of media.

2. The reversing apparatus according to claim 1, said reversing nips being selected by said controller to have said sheets of media continuously within at least one of said input nip, said reversing nips, and said output nip.

3. The reversing apparatus according to claim 1, said reversing nips reversing direction of all of said sheets of media.

4. The reversing apparatus according to claim 1, said reversing nips being selectively driven by said controller.

5. The reversing apparatus according to claim 1, each of said input nip, said reversing nips, and said output nip comprising a point where opposing rollers contact each other.

* * * * *